US005653370A

United States Patent [19]

Bereiter et al.

[11] Patent Number: 5,653,370

[45] Date of Patent: Aug. 5, 1997

[54] EXPLOSIVE POWDER CHARGE OPERATED FASTENING ELEMENT SETTING TOOL

[75] Inventors: Rolf Bereiter, Grabs; Peter Goepfert, Bonstetten, both of Switzerland

[73] Assignee: Hilti Aktiengesellschaft, Schaan, Liechtenstein

[21] Appl. No.: 583,368

[22] Filed: Jan. 5, 1996

[30] Foreign Application Priority Data

Jan. 7, 1995 [DE] Germany ..... 195 00 320.9

[51] Int. Cl.[6] ..... B25C 1/04

[52] U.S. Cl. ..... 227/10; 173/162.2; 173/170

[58] Field of Search ..... 227/9, 10, 130; 173/162.1, 162.2, 170, 206, 207, 208

[56] References Cited

U.S. PATENT DOCUMENTS

| | | | |
|---|---|---|---|
| 2,574,059 | 11/1951 | Prache . | |
| 2,966,829 | 1/1961 | Tannenbaum . | |
| 3,646,757 | 3/1972 | Sanders et al. | 227/130 |
| 3,985,061 | 10/1976 | Montgomery . | |
| 4,274,495 | 6/1981 | Otto | 227/162.1 |
| 4,658,913 | 4/1987 | Yantsen et al. | 173/208 |
| 4,774,873 | 10/1988 | Shoales . | |
| 4,883,211 | 11/1989 | Philipp . | |
| 5,213,247 | 5/1993 | Gschwend et al. | 227/10 |

OTHER PUBLICATIONS

European Search Report, No. EP 95 810 773.2 dated Apr. 25, 1996.

*Primary Examiner*—Scott A. Smith

*Attorney, Agent, or Firm*—Anderson Kill & Olick P.C.

[57] ABSTRACT

An explosive powder charge operated fastening element setting tool has a hydropneumatic damping unit (17) and includes a housing part (1) forming a piston guide (5, 6) for driving fastening elements and a handle part (15) displaceable against the force of the damping unit (17) in the setting direction relative to the housing part (1). The handle part (15) supports a cylinder (18) containing a liquid medium (21) under gas pressure. The housing part (1) cooperates with a piston (23) displaceable in the cylinder (18) against the flow resistance of the liquid medium (21). The damping unit (17) has no moving valve parts. At least one through aperture (24) is provided for the liquid medium (21) flow between a front and a rear cylinder space when the piston (23) is displaced. The aperture (24) has a least cross-section (M) so that the liquid medium flowing into the front cylinder space as a fastening element is driven has an effective flow cross-section corresponding to the least cross-section of the aperture (21), while after the fastening element has been driven the effective flow cross-section of the aperture from the front cylinder space into the rear cylinder space is smaller than the least cross-section of the aperture.

6 Claims, 3 Drawing Sheets

EXPLOSIVE POWDER CHARGE OPERATED FASTENING ELEMENT SETTING TOOL

BACKGROUND OF THE INVENTION

The present invention is directed to an explosive powder charge operated fastening element setting tool with a hydropneumatic damping unit, a housing for guiding a driving piston, and a handle part displaceable in the setting direction relative to the housing against the force of the hydropneumatic damping unit. The handle part has a space for a cylinder containing a liquid medium under gas pressure and the housing cooperates with a piston displaceable in the cylinder against the flow resistance of the liquid medium, and the piston divides the cylinder into a front cylinder space and a rear cylinder space.

Explosive powder charge operated setting tools use a driving piston powered by the expanding gasses of an ignited propellant charge which drives the fastening element to be driven. Usually such setting tools have a relatively large rebound, therefore, in the past effort has been made to dampen the rebound to make the tool more comfortable for use by an operator.

An explosive powder charge operated fastening element setting tool is disclosed in U.S. Pat. No. 2,731,636 which has a guide housing for the driving piston guide. A spring is provided between the guide housing and a handle displaceable relative to it and is meant to absorb and dampen the rebound or recoil acting on the tool operator when a fastening element is being driven. The damping effect of such a spring is sufficient only at low spring rates. A low spring rate necessitates a large spring and a larger space for housing the spring, so that a tool equipped with such an arrangement is difficult to handle. Using a smaller spring with a higher spring rate lowers the damping effect, whereby a high share of the undesirable rebounding forces still act on the tool operator. Further, the restoring velocity in such known springs is very high, so that during the restoring operation undesirable shocks act on the tool operator.

To avoid these problems it is proposed in EP-A-0 331 168 to use a hydropneumatic damping unit with valve systems. In such a tool the recoil is absorbed by the hydropneumatic damping unit formed by a cylinder containing a liquid medium under gas pressure and a piston located within the cylinder and displaceable opposite to the flow resistance of the liquid medium. The cylinder is supported in a housing part connected to the guide part. A shaft connected to the piston protrudes from the cylinder and abuts the handle part. If the handle part and the guide housing are displaced relative to one another, the displacement force is transmitted to the piston by the shaft. The piston divides the cylinder into a front cylinder space and a rear cylinder space. The liquid medium to which pressure is applied during the movement of the piston, flows through the valves from the rear into the front cylinder space and in the opposite direction. The valve system using butterfly valves controls the flow apertures for the liquid medium cylinder depending on the direction of movement of the piston. When the piston moves into the liquid medium, the aperture cross-sections of the valves are larger than the when the piston moves in the opposite direction. Therefore, the damping effect is greater when the piston is moved back out of the medium than during the driving process and the piston returns slowly into its original position. Without such control of the aperture cross-section of the valves, the piston would bounce back in a springlike manner which can result in undesirable shocks affecting the tool operator.

Extreme shock loads can occur in operation due to the explosion-like expansion of propellant gases in the tool. Accordingly, shockwaves can be transmitted through the shaft to the damping arrangement. Particularly, the butterfly vlves of the valve system are exposed to considerable loads and can be destroyed limiting the damping effect. In an extreme situation, the aperture cross-section of the valves is no longer reduced when the piston is pulled back and damping is not increased and the piston rebounds in a resilient, springy fashion.

SUMMARY OF THE INVENTION

Therefore, it is the primary object of the present invention to provide an improvement in an explosive powder charge operated fastening element setting tool with a damping arrangement so that there is no noticeable reduction of the damping effect upon the recoil occurring during the setting process over the useful life of the tool. In particular, a springlike rebound of the piston of the damping unit must be reliably avoided when a fastening element is driven. The setting tool is intended to afford comfortable operation of the tool for its operator and to avoid undesirable shocks from being directed against the tool operator. At the same time, the tool is improved with an easy to handle arrangement while fulfilling the above-mentioned requirements.

In accordance with the present invention, the damping unit is provided with an aperture for conveying the liquid medium between the front and rear cylinder spaces. The aperture has at least a first cross-section so that the liquid medium flowing into the front cylinder space from the rear cylinder space, as a fastening element is being driven, has an effective flow cross-section corresponding to the first cross-section of the aperture. When said liquid medium flows from the front cylinder space back into the rear cylinder space, after the fastening element has been driven, it has an effective flow cross-section smaller than the first flow cross-section of the aperture. In particular, a conventional explosive powder charge operated fastening element setting tool is improved so that the hydropneumatic damping unit has no moving valve parts.

The arrangement of the hydropneumatic damping unit without butterfly valves has the advantage that shock waves occurring during the setting operation cannot lead to damage to the valve arrangement whereby there is no impairment of the damping effect. The arrangement of the flow through aperture for the liquid medium flowing from the rear cylinder space into the front cylinder space and in the opposite direction during the displacement of the piston within the cylinder assures that the piston cannot quickly move into the cylinder whereby any recoil can be absorbed and dampened when a fastening element is being driven with the return of the piston into its original position being more strongly damped. In particular, the through aperture is shaped so that the liquid medium, displaced from the rear cylinder space as the piston is displaced, has the entire minimum cross-section of the through aperture available to it with the effective flow cross-section corresponding to the minimum flow cross-section. The return of the piston to its original position is braked by the liquid medium flowing back into the rear cylinder space with the flowpath being subjected to a contraction due to the specific arrangement of the through aperture. Accordingly, the effective flow cross-section of the medium flowing back is reduced in the region of the through aperture, it is up to 40% smaller than the minimum cross-section of the aperture. This reduction of the effective flow cross-section results in an increased resistance, as the piston urged back into its original position.

In an especially preferred embodiment, the through aperture has a sharp edge in the region of its minimum cross-section and is widened in the receding direction of the piston. It is assured by this arrangement of the through aperture that the effective flow cross-section during the return operation corresponds to the geometrical minimum cross-section of the through aperture. During the flow of the liquid medium in the opposite direction, the sharp edged rim of the through aperture in the region of its minimum flow cross-section creates turbulence in the liquid flow. This turbulence directly behind the minimum cross-section results in a contraction of the flow path. This effects a constriction of the effective flow cross-section.

Preferably, the cross-section of the through aperture in the return direction of the piston is shaped to widen in a continuous or quasi-continuous manner. In the ideal situation, at least on boundary surface of the through aperture is shaped to be continuously curved or phased in one or several steps. In this manner, an essentially laminar flow of the median is assured during the fastening element driving operation with the effective flow cross-section of the liquid medium corresponding to the geometric minimum cross-section of the through aperture. During the rebounding or returning of the piston to its original position, with the liquid medium flowing in the opposite direction, vortices or turbulence develops behind the impingement edge of the through aperture and such turbulence narrows the flow cross-section of the flow through aperture back into the rear cylinder space.

A preferred arrangement of the invention involves one or several through apertures in the piston or in the outer circumferential edge of the piston. In another embodiment the through aperture is shaped as an annular gap between the piston and the inside wall of the cylinder preferably interrupted by guidance webs. In this arrangement, the surface of the piston facing the front cylinder space extends essentially perpendicularly to the inner cylinder wall and has the largest diameter. The diameter of the piston decreases continuously or quasi-continuously towards the rear cylinder space. In this way the shape of the through aperture or apertures is achieved and at the same time a reliable guidance of the piston in the cylinder is assured because of the guidance webs.

In another embodiment of the invention, one or more of the through apertures are arranged as a bypass or bypasses in the cylinder wall. A front mouth of the bypass with the least cross-section is located in the front cylinder space. A rear mouth of the bypass has a larger cross-section than the least cross-section and is located in the rear cylinder space. The displacement travel of the piston extends between the two mouths. In this embodiment there is no specific requirements for the arrangement of the piston.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DETAILED DESCRIPTION OF THE INVENTION

Figure 1:
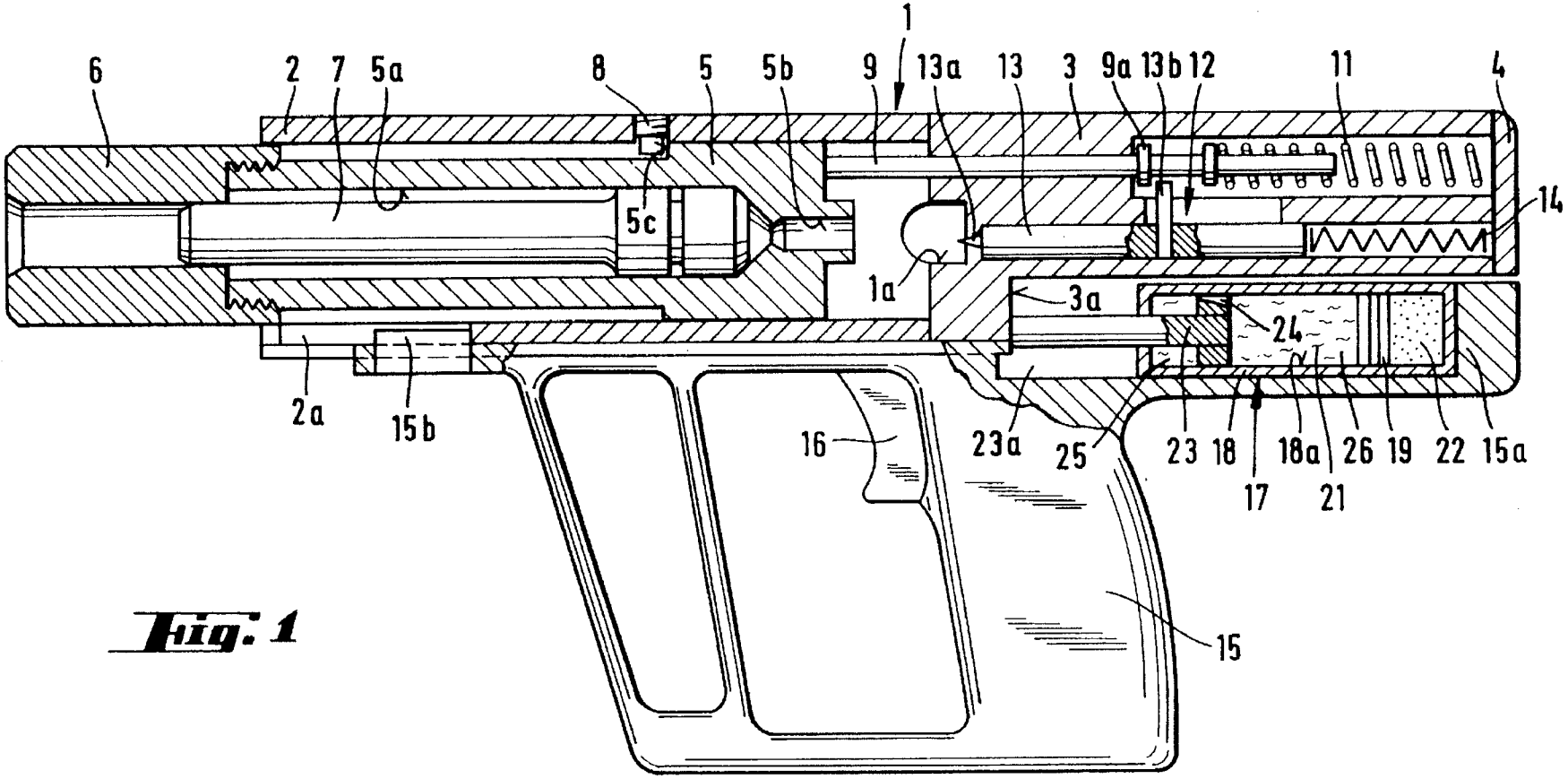
FIG. 1 is a side elevation view of a fastening element setting tool embodying the present invention is shown partly in section and illustrated in a position of rest.
Figure 2:
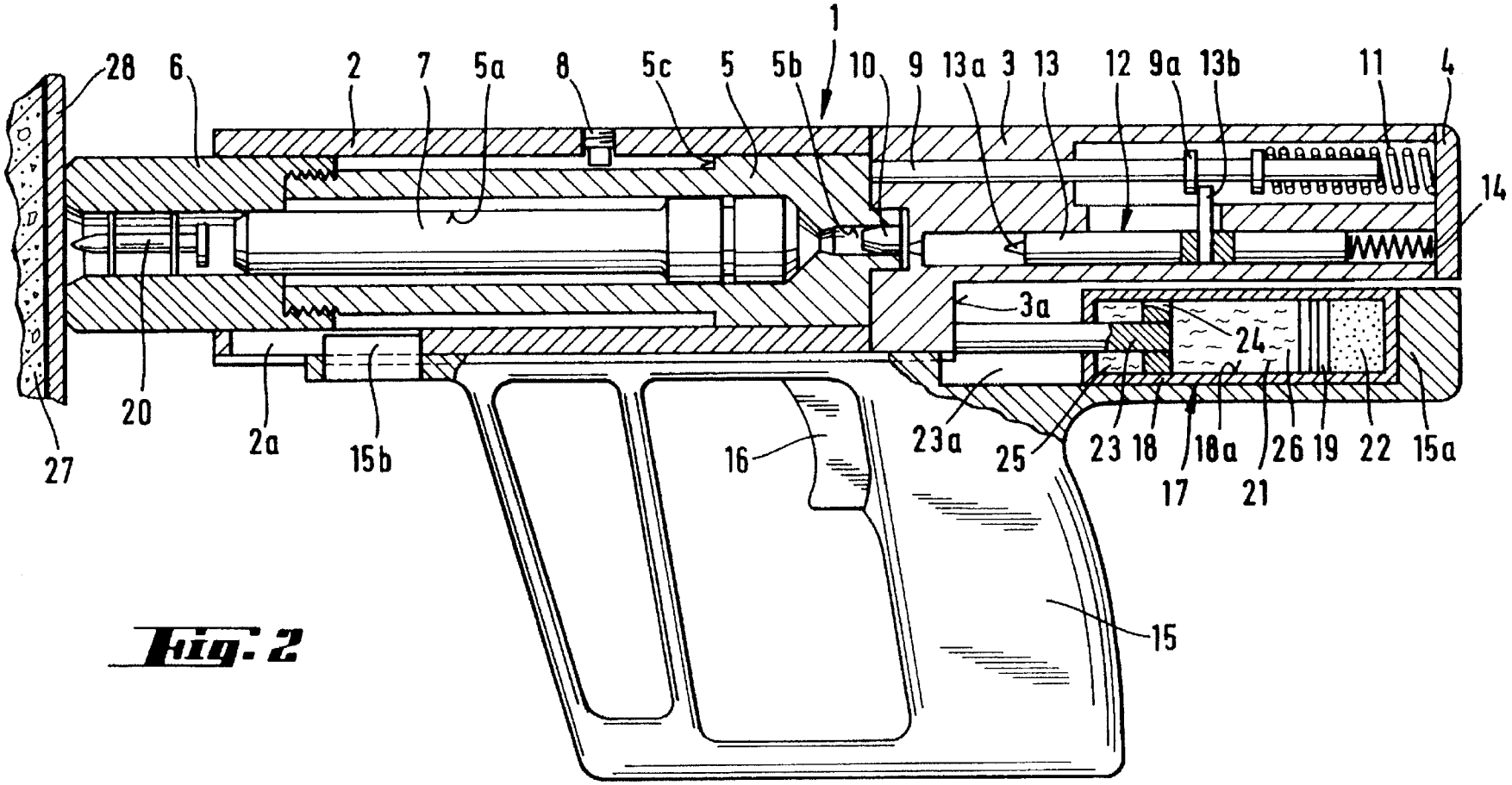
FIG. 2 is a view of the fastening element setting tool similar to FIG. 1 and illustrated in the ready-to-drive position.

In FIGS. 1 and 2 an explosive powder charge operated fastening element setting tool is shown formed of a multipart housing interconnected to form a single unit comprising a front housing part 2, a rear housing part 3 and a cover 4 sealing the rear housing part. A barrel 5 with a fastening element guide 6 at its front end is displaceably located in the front housing part 2. A driving piston 7 is located in the barrel 5 and the guide 6. A cartridge chamber **5*b* opens rearwardly of a barrel bore serving as a guide for the driving piston 7. The limitation of displacement travel of the barrel 5 and the bolt guide 6 is afforded by a stop screw 8 which cooperates with a shoulder 5*c* of the barrel 5. The barrel 5 is displaced into the stop position shown in FIG. 1 by a spring force 11 via a tappet 9 displaceably located in the rear housing part 3**.

A channel **1*a* is located in and passes through the housing 1 passing through the housing for feeding cartridges contained in a carrier strip. A firing arrangement 12 is located in the rear housing part 3. The firing arrangement consists of a firing pin 13 with a firing tip 13*a* projecting in the setting direction into the channel 1*a*. A driving pin 13*b* extends transversely of and passes through the firing pin which is shifted into the displacement path of an entrainment shoulder 9*a* on the tappet 9 for cocking the firing arrangement 12. The firing pin 13 is biased in the setting direction by a firing spring 14 and, like the spring 11, it abuts at its rear end against the cover 4**.

As viewed in FIGS. 1 and 2, a handle part 15 extends downwardly parallel to the axis of the housing. A trigger 16 is located in the handle part 15. A damping unit 17 is secured against an abutment face **3*a* on the rear housing part 3 and is positioned in a trough 15*a*. The damping unit 17 includes a cylinder 18 with a separation piston 19 located in its rearward region. The cylinder is filled with a liquid medium 21, such as oil, ahead of the piston 19. A precompressed gas cushion 22 is located rearwardly of the separation piston 19. The gas pressure is transmitted by the separation piston 19 to the liquid medium 21. A piston 23 is positioned in the cylinder containing the liquid medium 21 and the piston has an axially extending shaft 23*a* extending forwardly out of the cylinder and abutting against the rear housing part 3. The piston divides the cylinder containing the liquid medium into a front cylinder space 25 and a rear cylinder space 26 with the separation piston 19 located rearwardly in the rear cylinder space followed by the compressed gas cushion 22**.

The liquid medium 21 is subjected to the pressure of the gas cushion 22 and acts on all of the surfaces of the piston 23 located in the cylinder 18. The rear end face of the piston 23 is larger transversely of the axis of the cylinder than the front end face which is reduced by the cross-sectional area of the shaft **23*a*. The differences in area drive the piston 23 forwardly against the abutment face 3*a*. This holds the handle part 15 in the position shown counter to the driving direction relative to the housing 1, the abutment of a stop portion 15***b* on the handle at the end of a longitudinal aperture 2*a* in the house part 2.

As shown in FIG. 2, the ready for firing position of the fastening element setting tool is reached by pressing the tool containing a cartridge 10 and a fastening element 20 in the bolt guide 6 against a part 28 to be attached to a structure 27. Due to such pressing action, the tappet 9 is displaced by the barrel 5 in the housing 1 opposite to the driving direction against the biasing force of the spring 11. In addition, the tappet 9 drives the firing pin 13 opposite to the driving direction against the force of the firing spring 14 by the entrainment of the driving pin 13*b* which the entrainment shoulder 9*a*. The forces which have to be overcome to obtain the ready for firing position are smaller than the response force of the damping unit 17, whereby the forces can be transmitted from the handle part 15 to the housing 1, without any relative displacement of these parts.

The damping unit 17 is arranged to absorb the recoil during the driving of a fastening element and it prevents the transmission of interfering or even harmful shocks to the tool operator. The recoil forces of the barrel 5 are transmitted by the housing 1 to the piston 23. Distinguishing over the arrangements known from the state of the art, the inventive damping system is equipped with through apertures 24 without any butterfly valves for the liquid medium 21 to which pressure is applied during the displacement of the piston 23. Due to the recoil forces of the barrel 5, the piston moves rearwardly into the cylinder 18 and the liquid medium 21 flows from the rear cylinder space 26 to the front cylinder space 25. The through apertures 24 are shaped so that the entire minimum cross-section of the apertures 24 is available to the liquid medium during such rearward movement of the piston. The effective flow cross-section S of the liquid medium flowing from the rear cylinder space 26 into the front cylinder space 25 corresponds to the least cross-section of the through apertures 24. This least cross-section as well as the quantity of the through apertures 24 are selected in such a way that a rapid damped movement of the piston occurs.

The piston returns to the initial position shown in FIG. 1 due to the pressure of the gas cushion 22, as described above. The through apertures 24 are shaped so that the effective flow cross-section S for the liquid medium flowing from the front cylinder space 25 into the rear cylinder space 26 is smaller than the least diameter of the through apertures 24. This arrangement affords an increased resistance of the liquid medium to the return movement of the piston 23 and increases the damping effect, whereby the piston is returned slowly to its initial starting position. After the setting tool is lifted from the surface of the structure, the spring 11 and the firing spring 14 displace the other parts into the rest position.

Figure 3:
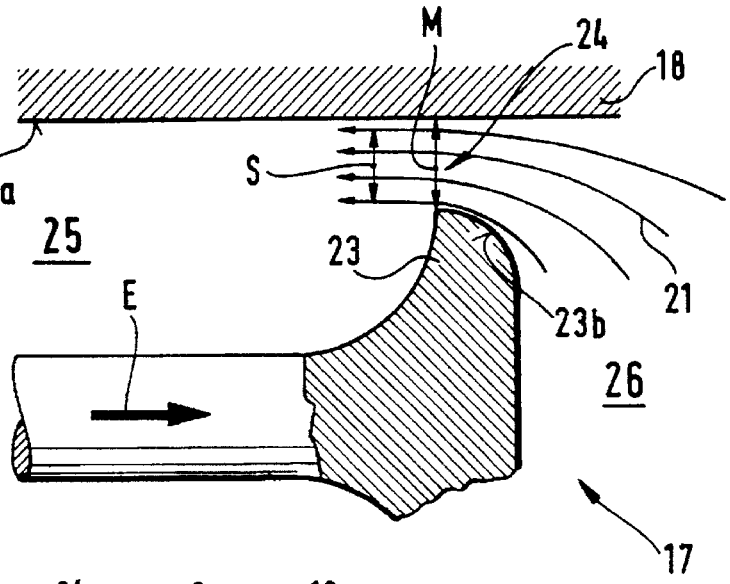
FIG. 3 is a diagrammatic representation of a first embodiment of the inventive damping arrangement with a displaceable piston.
Figure 4:
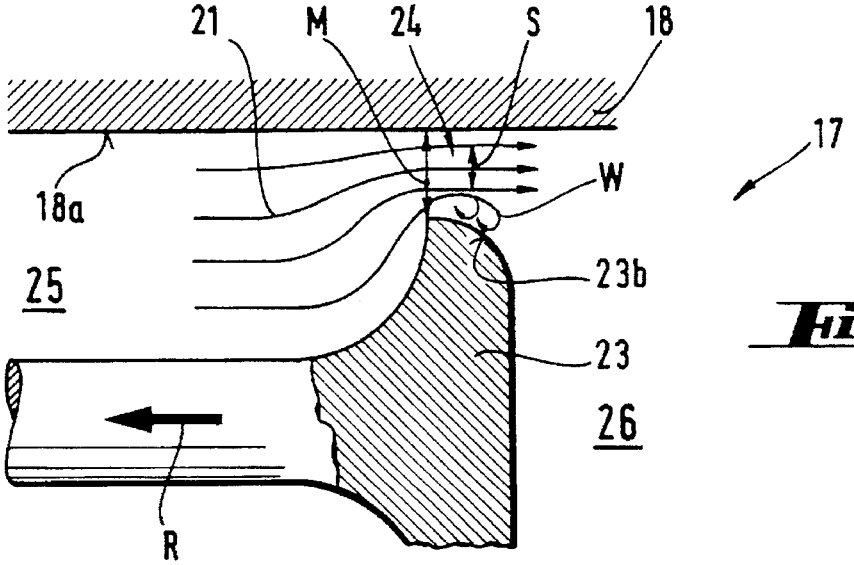
FIG. 4 is a diagrammatic representation similar to FIG. 3 with the piston returning to its original position.

The operation of the inventive damping unit 17 with specifically arranged through apertures 24 is shown diagrammatically in FIGS. 3 and 4. In the damping unit 17 shown by the partial view in FIG. 3, the rearward displacement of the piston 23 is indicated by an arrow E. In the course of the rearward movement, the liquid medium 21 flows from the rear cylinder space 26 through the aperture 24 into the front cylinder space 25. The through aperture is bounded by the cylinder inner wall 18*a* and the outer surface 23*b* of the piston facing the inner wall. The liquid medium 21 is shown by flow lines. Due to the special arrangement of the through apertures 24, the flow remains essentially laminar and the effective flow cross-section of the liquid medium corresponds to the least cross-section M of the through aperture. In the illustrated embodiment, the cross-section of the through aperture 24 increases continuously in the direction into the rear cylinder space 26 extending from the least cross-section M. Accordingly, one boundary surface of the through aperture formed by the piston surface 23 facing the cylinder inner wall 18*a* is shaped in a curved manner.

In FIG. 4 an embodiment is shown where the cross-section of the through aperture 24 widens quasi-continuously. This is achieved with the piston surface 23*b* facing the cylinder wall 18*a* so that it is phased in one or several steps. In the illustrated embodiment, the piston surface 23*b* is phased in three steps. In the course of the return of the piston 23 to its initial or starting position, as shown in FIG. 1, the liquid medium 21 displaced from the front cylinder space 25 flows through the through aperture 24 into the rear cylinder space 26. At the sharp edged rim of the through aperture 24 facing the front cylinder space 25, turbulence or vortices W are formed resulting in a contraction of the flow path of the fluid or the liquid medium 21. This contraction results in reducing the effective flow cross-section S to one smaller than the least cross-section M of the through aperture 24. As a result, there is a considerable throttling of the flow of the liquid medium whereby the piston 23 is returned slowly into its initial position.

Figure 5:
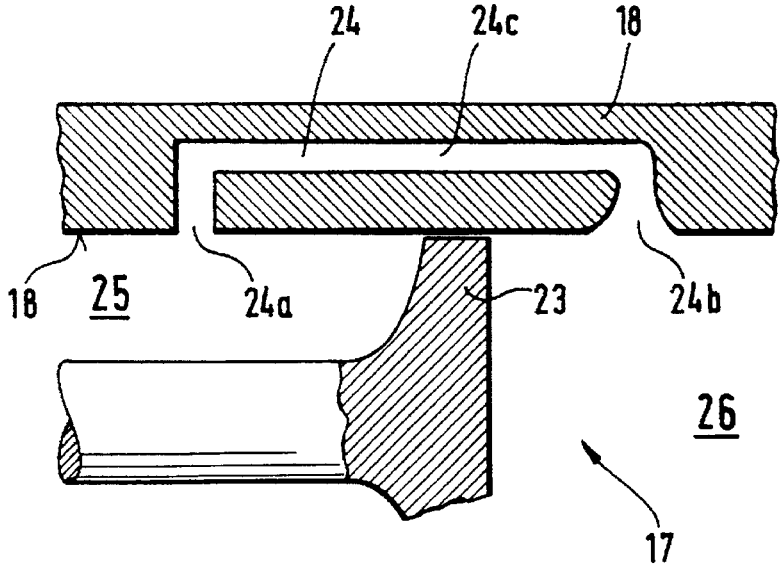
FIG. 5 is a partial diagrammatic representation of another embodiment of the damping unit of the present invention, shown partially in section.

FIG. 5 illustrates another embodiment of the damping unit 17 in a diagrammatic showing similar to FIGS. 3 and 4. In this arrangement, the through aperture 24 is formed as a bypass in the wall of the cylinder 18. The cylinder has two mouths or openings 24*a* 24*b* interconnected by a channel 24*c*. Front mouth 24*a* is located in the front cylinder space 25 spaced forwardly of the piston 23 and the rear mouth 24*b* is located in the rear cylinder space 26 rearwardly of the maximum displacement position of the piston 23. The displacement travel of the piston 23 extends between the two mouths 24*a* 24*b*. The behavior of the damping unit 17 in the course of the rearward movement of the piston 23 and its return movement is due to the different arrangement of the mouths. The rear mouth 24*b* is preferably widened in a funnel shaped manner and has no sharp edged boundary regions. On the contrary, the front mouth 24*a* has sharp edges at which turbulence or vortices develop and continue through the channel 24*c* resulting in a contraction of the liquid medium flow path.

Grooves milled into the cylinder wall afford a particularly simple embodiment of the damping unit, not shown, where the grooves extend centrally in the region of the front and rear cylinder spaces. The grooves cooperate with a piston resting against the inner cylinder wall in a sharp edged manner with a cross-section diminishing continuously or quasi-continuously in the direction of the rear cylinder space proceeding from the contact region of the piston.

The explosive powder charge operated fastening element setting tool, embodying the present invention experiences no impairment worth mentioning due to the recoil occurring during the course of the setting process during the entire useful life of the tool. Springy rebounding of the piston of the dampening unit after the initial displacement is reliably prevented. The setting tool is comfortable for the operator to handle, since no shocks worth mentioning are transmitted to the operator. In addition, the tool is easy to handle.

While a specific embodiment of the invention has been shown and described in detail to illustrate the inventive principles, it will be understood that the invention may be embodied otherwise without departing from said principles.

We claim:

1. An explosive powder charge operated fastening element setting tool, including a hydropneumatic damping unit

(17) and comprising an axially extending housing (1) having a leading end from which fastening elements are driven in a driving direction and containing an axially extending piston guide (5, 6) for guiding the fastening elements and a handle part (15) displaceable in the driving direction relative to said housing against the force of said hydropneumatic damping unit (17), a cylinder (18) located in said handle part (15) and extending in the axial direction of said housing, said cylinder (18) containing a liquid medium (21) under gas pressure, a piston (23) located within said cylinder (18) and displaceable therein against flow resistance of said liquid medium (21), said piston (23) divides said cylinder (18) into a front cylinder space (25) and a rear cylinder space (26), said hydropneumatic damping unit (17) being free of moving valve parts, at least one through aperture (24) for the liquid medium (21) flowing between said front cylinder space (25) and said rear cylinder space (26) as a fastening element is driven having an effective flow cross-section (S) when the liquid medium flows from the rear cylinder space into the front cylinder space which corresponding to a first cross-section (M) of said aperture (24) and said liquid medium flowing from said front cylinder space (25) into said rear cylinder space (26) has an effective flow cross-section (S) smaller than the first cross-section (M) of said at least one aperture (24).

2. An explosive powder charge operated fastening element setting tool, as set forth in claim 1, wherein said through aperture (24) is sharp edged at its circumference in the region of the first cross-section (M) and shaped to widen in the direction from the front cylinder space (25) to the rear cylinder space (26).

3. An explosive powder charge operated fastening element setting tool, as set forth in claim 2, wherein the at least one through aperture has an expanding cross-section essentially continuous or quasi-continuous with at least one boundary surface (24*b*) of said at least one aperture (24) shaped in a curved manner or phased in at least one step.

4. An explosion powder charge operated fastening element setting tool, as set forth in claim 1 or 2, wherein said at least one through aperture (24) is located in one of said piston and at an outer circumferential surface of said piston (23).

5. An explosive powder charge operated fastening element setting tool, as set forth in claim 4, wherein said at least one through aperture (24) is formed between said piston (23) and an inner wall of said cylinder (18*a*) with the piston having a face directed towards the front cylinder space (25) extending substantially perpendicularly to said cylinder inner wall (18*a*) and having a largest diameter with the diameter of the piston reducing in one of a continuously and quasi-continuously manner from said front cylinder space (25) to said rear cylinder space (26).

6. An explosive powder charge operated fastening element setting tool, as set forth in claim 1 or 2, wherein said at least one through aperture (24) is shaped as a bypass (24*a*, 24*b*, 24*c*) having a first mouth (24*a*) opening to said front cylinder space (25) and a second mouth (24) opening to said rear cylinder space wherein said first mouth has a cross-section corresponding to said first cross-section and said second mouth has a cross-section larger than the first cross-section (M) and said piston (23) having a displacement travel extending between said first and second mouth (24*a*, 24*b*).

* * * * *